US005479916A

United States Patent [19]

Shimek et al.

[11] Patent Number: 5,479,916

[45] Date of Patent: Jan. 2, 1996

[54] LOW PROFILE GAS BURNER FIREPLACE TABLE

[76] Inventors: Ronald J. Shimek; Daniel C. Shimek, both of 6665 W. Hwy. 13, Savage, Minn. 55378

[21] Appl. No.: 369,741

[22] Filed: Jan. 6, 1995

[51] Int. Cl.[6] ..... F24C 3/00

[52] U.S. Cl. ..... 126/512; 126/515; 126/516; 126/519; 126/76; 126/85 B

[58] Field of Search ..... 126/512, 515, 126/516, 519, 85 B, 76, 69

[56] References Cited

U.S. PATENT DOCUMENTS 5,074,284 12/1991 LeLong et al. ..... 126/515

5,218,953 6/1993 Shimek et al. ..... 126/512

*Primary Examiner*—Carroll B. Dority

*Attorney, Agent, or Firm*—John B. Sowell

[57] ABSTRACT

A low profile gas burner fireplace is provided for mounting under a low table top or counter. The fireplace system comprises a decorative insulated table top mounted on the top wall of a low profile fireplace. The fireplace is provided with a hot exhaust gas system that connects below the burner system and passes through the bottom wall of the fireplace structure to conduct hot gasses through the bottom wall and outside of the room area in which the fireplace is located by means of an induced draft fan so that no pipes or exhaust system are visible in the room in which the fireplace is located.

17 Claims, 6 Drawing Sheets

LOW PROFILE GAS BURNER FIREPLACE TABLE

BACKGROUND OF THE INVENTION

1. Field of the Invention

The present invention relates to decorative gas appliances. More particularly the present invention relates to a fireplace of the type which is mounted under and becomes the support for a table top such as a coffee table, corner table, kitchen counter or island table.

2. Description of the Prior Art

In our U.S. Pat. No. 5,016,609, we disclosed and described a zero clearance fireplace with glass side panels which contained insulation and a heat exchanger plenum in the top wall. The top wall of this fireplace was cool enough to be built into a vertical wall or walls and/or to support a high counter. The top of this fireplace presents a high profile and is too high to accommodate a low profile table top.

In our U.S. Pat. No. 5,218,953, we disclosed a very high thermal efficiency fireplace capable of operating at variable heating output rates. This fireplace employed a variable rate induced draft fan in the exhaust system to maintain a predetermined pressure drop across the combustion chamber. The exhaust fan in this fireplace system was not designed to effect cooling of any of the walls surrounding the combustion chamber.

It would be desirable to provide a gas burning fireplace system which could serve as the base for a low profile table top and which displayed a decorative gas log burner system and which also maintained the glass side walls at a temperature low enough to be touched by the human hand or human body without causing burns, physical discomfort or harm.

SUMMARY OF THE INVENTION

It is a primary object of the present invention to provide a low profile fireplace system for supporting a coffee table top or a countertop.

It is a primary object of the present invention to provide a low profile fireplace for mounting under a table top.

It is a primary object of the present invention to provide a fireplace system with glass side walls cool enough to be touched by the human hand or the human body.

It is a primary object of the present invention to provide a decorative fireplace appliance with cooled top and side walls which displays a gas burner system behind glass side walls.

It is a primary object of the present invention to provide a decorative gas fireplace appliance which may be completed with a top of combustible materials, such as wood or plastic as well as non-combustible materials such as glass or marble.

It is a primary object of the present invention to provide a decorative glass fireplace table appliance that may be installed as a vented island appliance in a room with up to four glass side walls of the fireplace exposed without visible vent pipes.

It is another object of the present invention to provide a novel fresh air system in a bottom wall in the fireplace table which provides a cool fresh air combustion shroud around the burner system to cool the top and side walls of the fireplace system.

According to these and other objects of the present invention, there is provided a low profile gas burner fireplace table having a decorative insulated table top mounted on the top wall of the fireplace. The fireplace is further provided with a hot exhaust gas system that connects through the bottom wall below the burner system to conduct hot gasses from inside of the combustion chamber to a point outside of the room in which the fireplace table is installed so that no pipes or exhaust system are visible.

DETAILED DESCRIPTION OF THE PREFERRED EMBODIMENTS

Figure 1:
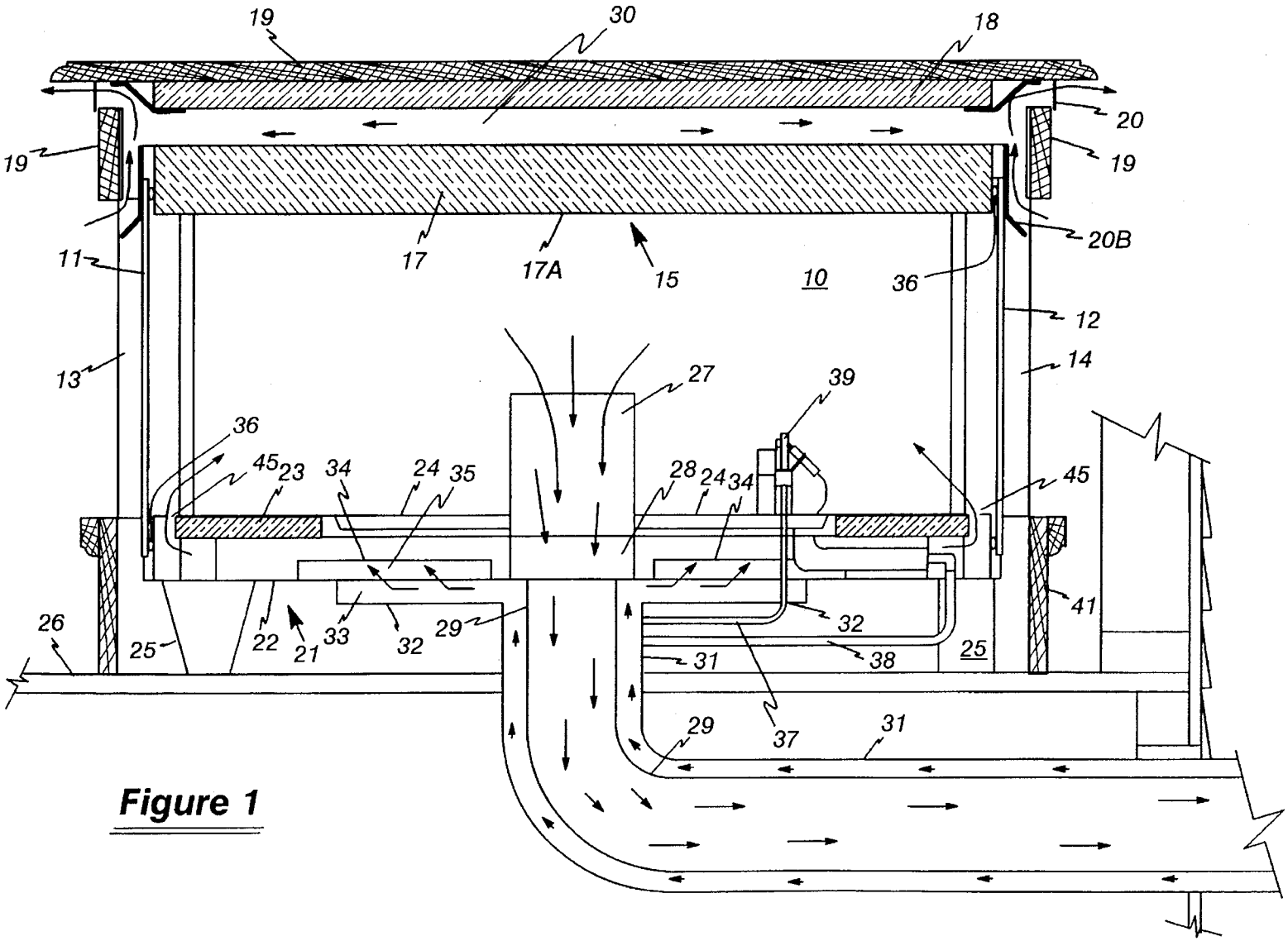
FIG. 1 is a front elevation in section of the present invention low profile fireplace table showing a gas burner in the fireplace system which supports a removable table top.

Refer now to FIG. 1 showing a front elevation in section of a preferred embodiment of the present invention low profile coffee table having a gas burner fireplace system supporting a removable table top.

The fireplace 10 generally comprises a plurality of glass panel side walls two of which are shown as glass panels 11 and 12 mounted on and between four corner vertical posts or columns 13 and 14, two of which are shown. The posts 13 and 14 are connected to a top wall 15 which comprises top panel 17A of a hollow sheet metal plenum 17 that may be filled with high temperature fiber insulation or filled with insulating air. Wall 15 includes a second insulation layer 18 spaced part from the top of plenum 17. A removable table top 19 is shown mounted on and over the insulation layer 18. The top wall insulation including air space 30 is sufficient to maintain the table top 19 at a temperature low enough not to harm wood, plastic or marble and is not too warm to the human touch.

Convection air which rises on the glass panel is diverted outward by baffles 20B. Fresh cool room air enters the space above baffle 20B and rises behind wood surround piece 191 if table top 19 and exits through mesh 20. The movement of air through mesh 20 syphons some air from air space 30 providing further insulation to the top 19 which may be made of combustible materials. While the preferred embodiment of the present invention includes air spaces at the edges and under table top 19, the novel air spaces may be filled with insulation when high heat output from the combustion chamber is lowered.

A bottom wall 21 comprises a lower panel 22 and an upper panel 23. A pair of flat pan burners 24 are mounted in apertures in the upper panel 23 which is made of ceramic fiber and molded to resemble a brick or tile pattern. The bottom wall 21 is supported on legs 25 and supports the fireplace 10 above a floor 26.

In the preferred embodiment of the present invention, an exhaust passage or passageway 27 extends through the plane of the upper panel 23 and terminates at or near the top of the gas log system to be described in greater detail hereinafter. The exhaust passageway 27 is preferably a narrow rectangular duct which connects into rectangular plenum 28 that has sufficient bottom surface area to connect to a cylindrical exhaust stack 29 that carries burned exhaust gases to a point outside of the room in which the fireplace 10 is located.

In the preferred embodiment of the present invention, a coaxial pipe 31 is shown surrounding the exhaust stack 29 and supplies fresh air from an outside source to a bottom pan 32. Pan 32 connects to the bottom panel 22 and forms a plenum 33 therebetween. The bottom panel 22 of the bottom wall supports a pair of top pans 34 and a plenum 35 is formed therebetween. The top pans 34 extend transversely to the edge of the sidewalls (not shown) and conduct the fresh combustion air to a point which forces it to rise along the vertical side walls before being supplied to the gas burner shown as flat pan burners 24. In the preferred embodiment of the present invention an excess amount of fresh combustion air is supplied at the side walls so that in addition to supplying combustion air a source of fresh air forms a shroud covering the gas logs 44 before entering the exhaust passageway 27. Before describing the gas logs 44 it will be noted that a gas pilot line 37 and a gas supply line 38 are shown connected to a pilot light 39 and the flat pan burners 24 respectively. A decorative wood surround 41 forms an enclosure around the bottom wall 21 and the space beneath the fireplace. The bottom surround 41 is removable once the table top 19 is removed to provide access to the gas controls and glass side walls which will be described in greater detail hereinafter.

Figure 2:
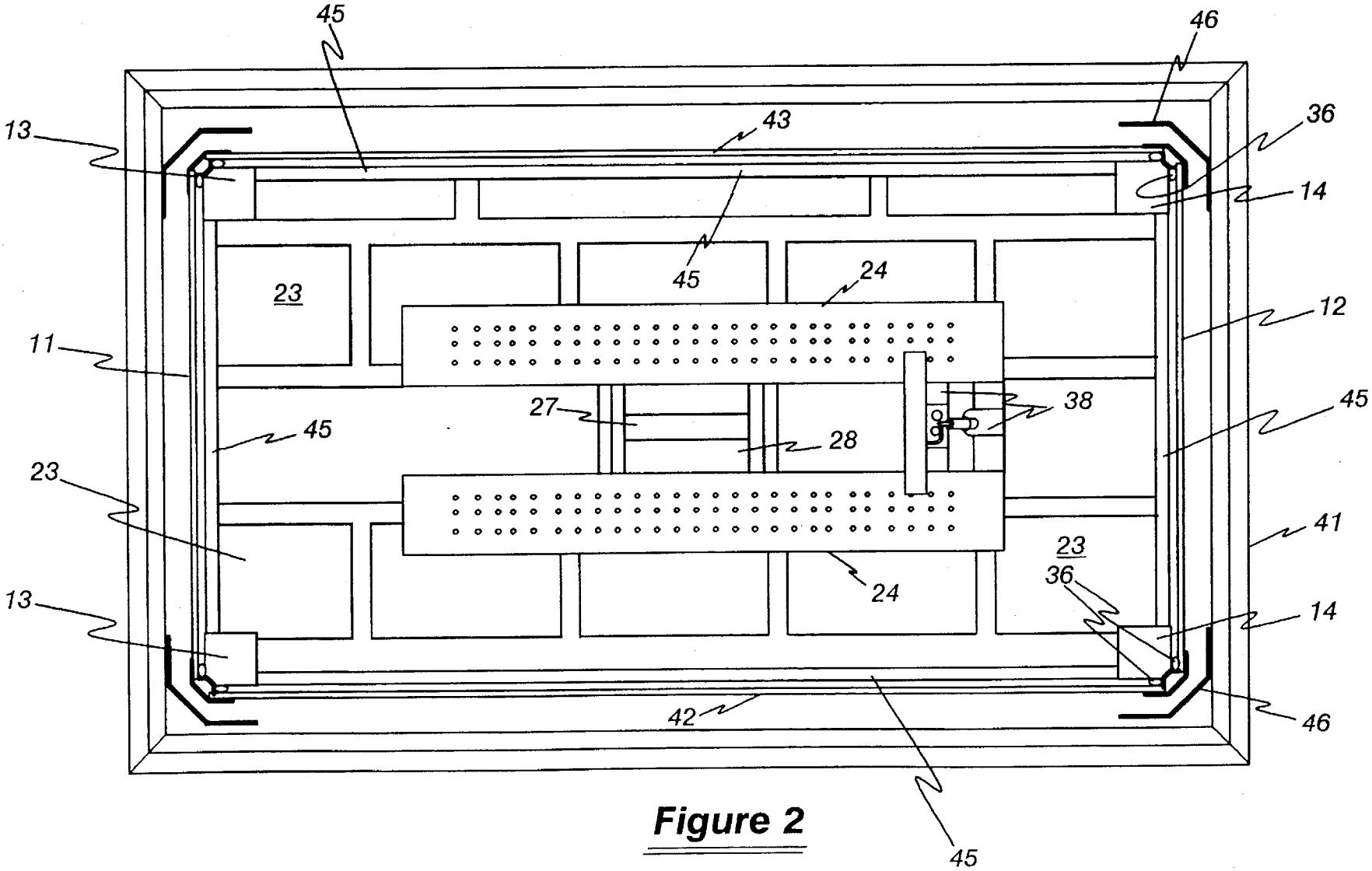
FIG. 2 is a top view in section of the fireplace table shown in FIG. 1 further showing a preferred gas burner system mounted at the upper panel of the bottom wall.

Refer now to FIG. 2 showing a top view in section of the fireplace having a preferred burner system 24 mounted in or on the upper panel 23 of the bottom wall. The flat pan burners 34 are connected to the gas supply lines 38. At the edges of the upper panel 23, there are provided slots 45 along the sides which permits the fresh air to form a shroud around the gas burner system. The numerals used in FIG. 2 are identical to those used in FIG. 1 and represent the same structure, thus do not require further explanation herein. It will be noted that in FIG. 2 the longitudinal glass panels 42 and 43 are like similar panels 11 and 12 which are sealed at the posts 13 and 14 and walls 15 and 21 using an insulating rope or sealer 36. The corner posts and the edges of the glass panels may be concealed by a decorative trim piece 46 which may be attached by magnetic or other means to permit easy removal when a glass panel is removed for access to the gas burner system.

In the preferred embodiment of the present invention, the table top 19 and shroud 19A may be easily removed in one piece to expose the top wall 15. Once the table top 19 is removed, the baffle 20B and decorative shroud 41 may be removed in one piece, thus, completely exposing the glass panels 11, 12, 42 and 43. The glass panels are designed so that they are easily removed to provide access either to the top burner system or to the gas valve system which is connected below the bottom wall 21.

Figure 3:
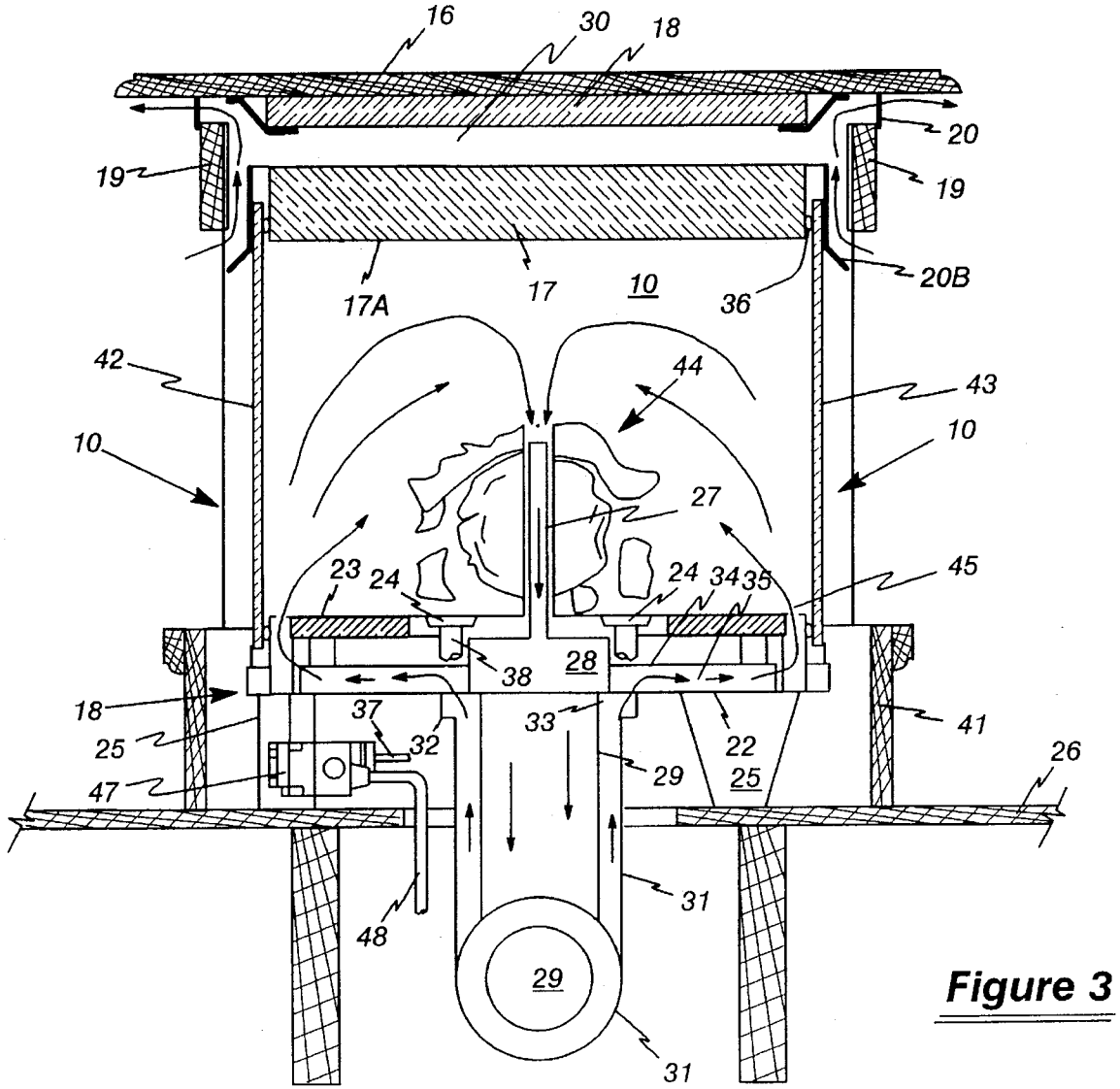
FIG. 3 is a side elevation in section of the table and fireplace shown in FIGS. 1 and 2, further showing gas logs mounted above the gas burner system and a central hot gas exhaust system extending through the logs and the bottom wall.

Refer now to FIG. 3 showing a side elevation in section of the fireplace table shown in FIGS. 1 and 2. The numbers on the elements of FIG. 3 are the same as those shown in FIGS. 1 and 2 and do not require additional explanation. The novel exhaust passageway 27 is shown extending up through the gas logs 44. The gas logs 44 are supported above the burners 24. The burners 24 preferably are partially exposed below the log system and create flames along the outside of the small logs as well as flames between the small logs and the large log. Thus, the flames appear to surround both the small and large log in a manner and color which exactly simulates that of a wood burning fire. In the preferred embodiment of the present invention, the fresh air supplied in the coaxial pipe 31 is shown entering plenum 33 and passing through the lower panel 22 into the plenum 35 before passing through the slots 45 formed at the edges of the panel 23. Thus, it will be understood that fresh air reaches the burner system after rising along the inner surface of the outer walls and then swirling to form a cool air shroud around the log system 44 while supplying combustion air. The cooling air mixes with hot exhaust gasses before entering the exhaust passageway 27 which is connected to the rectangular plenum 28 that provides an adapter and fitting for the exhaust stack 29.

A gas valve 47 is shown connected to a gas supply pipe 48. The gas valve 47 is supplied with a pilot line 37 and an outlet gas line 38.

Figure 4:
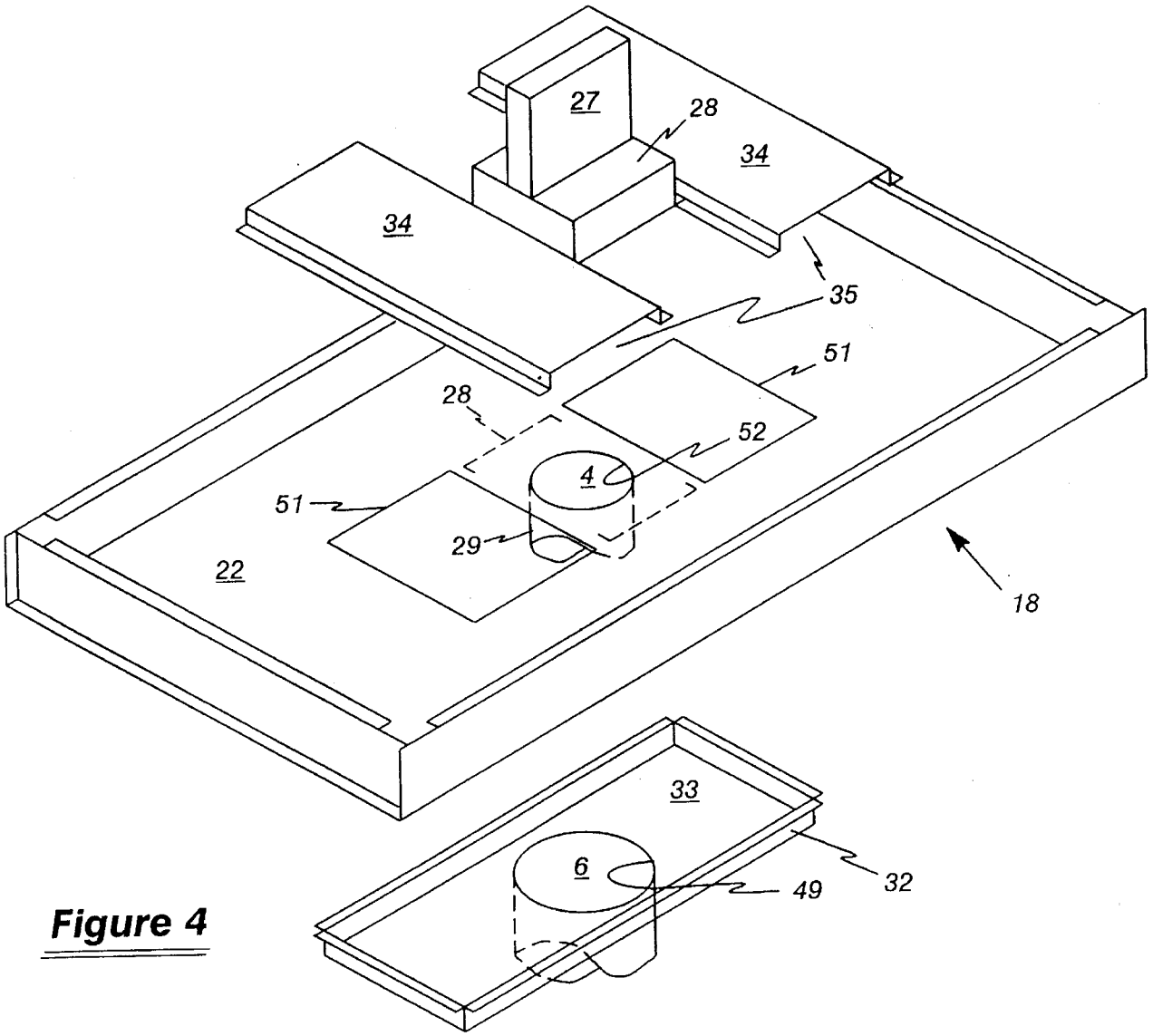
FIG. 4 is an isometric view showing the preferred embodiment sheet metal panels employed to produce the novel plenums in the bottom wall of the fireplace table which provide a cool air shroud around the gas burner system.

Refer now to FIG. 4 showing an isometric view of the preferred embodiment novel sheet metal panels employed in the bottom wall of the fireplace table to form plenums which conducts the exhaust gases from the combustion chamber and conduct cool fresh air into the combustion chamber to form a shroud around the gas burner system. The fresh air pipe 31 is preferably connected to and sealed to bottom pan 32 at aperture 49. The fresh air in the plenum 33 formed by the panel 32 is directed longitudinally to the apertures 51 formed in the horizontal lower panel 22. The fresh air passing through apertures 51 enters into the plenums 35 formed by the top pans 34 and is directed transversely to the outer edges of the side walls of the fireplace 10 under top panel 23. Once the air is at the longitudinal side walls, it is forced to pass under the top pan 34 to the slots 45 described hereinbefore and from there it enters into the combustion chamber to form a cool air shroud as well as combustion air around the log system 44 and the burner system 24.

The burned exhaust gases and some of the excess fresh air enter the exhaust passageway 27 which is connected to the plenum 28. The plenum box 28 is shown having its bottom parameter in phantom lines 28 surrounding the exhaust aperture 52 which connects to the exhaust stack 29. Having described in detail the preferred embodiment sheet metal plenum system formed in the bottom wall 21, it will be appreciated that all of the hot exhaust gases which occur inside of the combustion chamber are pulled into the exhaust passageway 27 and away from the side walls so that the side walls are maintained cool enough to be touched. Further, the hot gases which ordinarily would form in the top of a combustion chamber and heat the top wall 15 are also pulled away from the top wall. Some of the excess fresh air also cools the top wall. The top wall plenum 17 comprises sheet metal panels and may require less insulation than that shown in FIGS. 1 through 3. In the preferred embodiment of the present invention, insulation 18 is placed above the outside of the sheet metal plenum 17 and the sheet metal plenum is insulated and/or filled with a dead air space.

Figure 5:
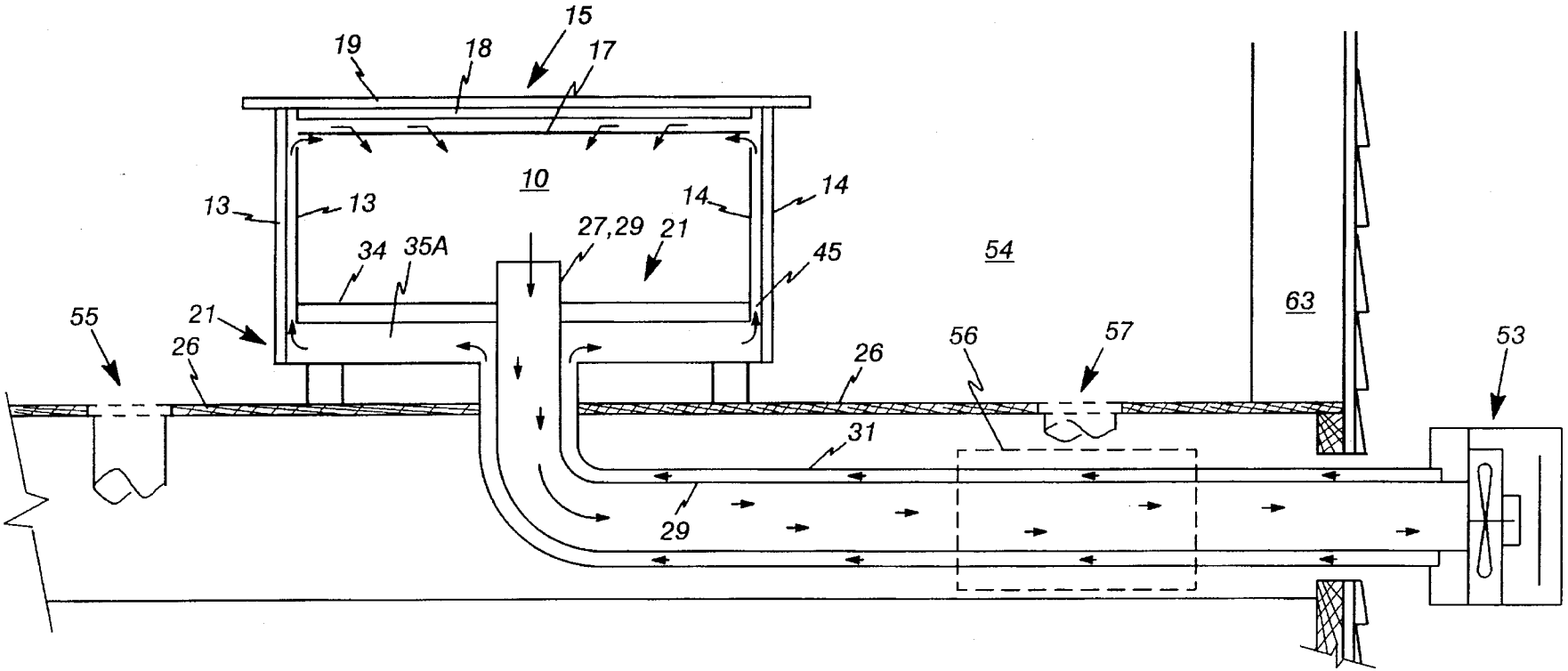
FIG. 5 is a schematic drawing in front elevation showing a modified embodiment of the structure for supplying fresh combustion air from an outside source to the gas burner system.

Refer now to FIG. 5 showing a schematic drawing in front elevation of a modified embodiment of FIGS. 1 through 3. In this embodiment, the corner posts 13 and 14 are made hollow and communicate with a plenum shown at 35A. The fresh air which enters the coaxial pipe 31 now enters into the plenum 35A and can enter through slots 45 or through the hollow columns 13, 14 and further supply cooling air to the hollow plenum 17 or enter the top wall 15 and/or plenum 17 and exit through apertures down into the combustion chamber as shown by the arrow to further cool the novel fireplace table top system. After the air enters through slots 45 and/or through the tops of the columns and/or top wall, the burned products of combustion enter the exhaust passageway 27 and exhaust stack 29 and are transferred to the induced draft fan system 53. Induced draft fans are known in the prior art and cause a negative pressure in the combustion chamber so that all exhaust gases are exhausted through an outside wall of the room 54 in which the fireplace table is located. It will be noted that a feature of this present invention is that none of the supply and exhaust pipes are visible to the human eye when the fireplace table system 10 is located in the center of a room 54. The novel fireplace system depicted in FIG. 5 maintains the side walls cool enough to be touched. However, heat is transferred into the room by radiation, but very little heat is transferred into the room by convection. If additional convection heat is desired, it is possible to place an in vent 55 in the floor and transfer the air to a heat exchanger 56 which heats the air from the in vent 55 and then discharges it through out vent 57.

Figure 6:
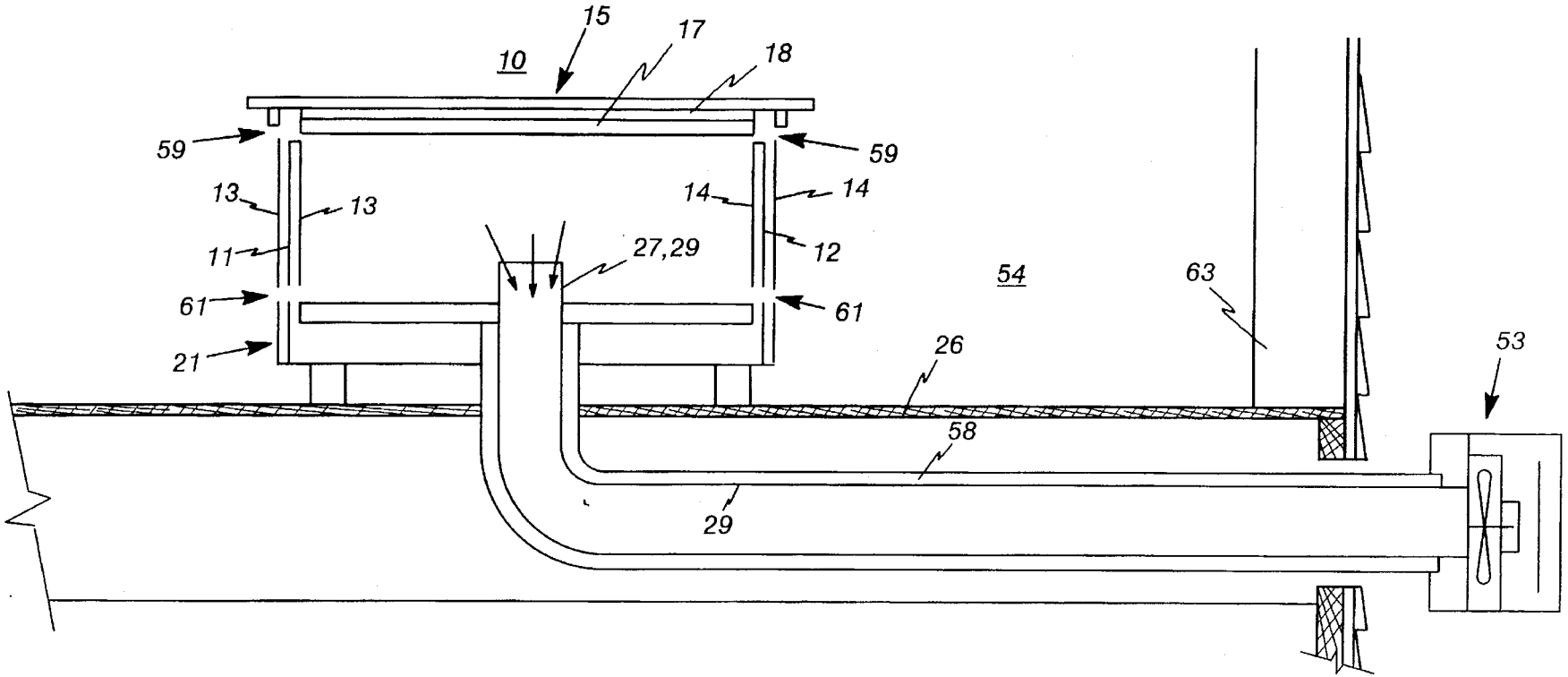
FIG. 6 is a schematic drawing in side elevation showing another modified embodiment of the structure for supplying fresh combustion air from a room to the burner system.

Refer now to FIG. 6 showing a schematic drawing in front elevation of another modified embodiment of the structure for supplying fresh combustion air from the room to the burner system. The fireplace table 10 is provided with a top wall 15 as described hereinbefore with reference to FIGS. 1 through 3. However, the side walls 11 and 12 are spaced away from the top wall 15 and/or columns 13 and 14 to provide air inlets 59 at the top of the side walls and/or air inlet 61 at the bottom of the side walls 11 and 12 which allow fresh combustion air from the room 54 to enter into the combustion chamber which surrounds at the exhaust 27, 29. The exhaust pipe 27, 29 is the same as that described hereinbefore and is connected to the induced draft fan system 53. However, the aforementioned coaxial pipe 31 is replaced by a insulating cylindrical jacket 58 which insulates the hot gas pipe 29 from the floor 26 and other parts of the wall and structure 63 through which the hot exhaust pipe 29 passes. In some areas of the country, it is too warm to have a hot roaring fire thus the novel modified system shown in FIG. 6 assures that the fresh combustion air is taken from the room and cools the room to the surroundings from which the air is taken. The insulated exhaust pipe prevents transmitting heat back into the structure in which the fireplace is located.

When the glass panels 11, 12, etc. are removed, the sides of the fireplace 10 are completely opening to form an open fireplace system. This open fireplace system is completely vented and none of the vent pipes are visible to the human eye. This additional modification provides an extremely desirable fireplace system for warm climates and does not permit any of the convection heat or combustion gases to enter into the room in which the novel fireplace table is located.

Having explained a preferred embodiment of the present invention with closed sealed side walls and modifications of the closed system showing how room air can be used to supply the combustion air and cooling air to the fireplace system and further how the system may be modified to provide an open vented system, it will be appreciated that all types of decorative designs may now be implemented in which simulated log fireplace may be placed anywhere in a dwelling or commercial building without vent pipes showing.

What is claimed is:

1. A low profile gas burner fireplace for mounting under a table top, comprising:

a box shaped fireplace structure having a plurality of walls comprising four substantially vertical walls, a top wall and a bottom wall, at least two of said side walls comprising glass panels, said top wall further comprising table top insulation, said bottom wall comprising a plurality of panels including an upper panel, a gas burner system in a combustion chamber inside said walls, an exhaust gas passageway extending through said upper panel of said bottom wall for conveying exhaust gasses downwards through said upper panel of said bottom wall, fresh air venting means for conducting combustion air through at least one of said walls other than top wall, an induced draft fan system comprising an exhaust stack connected to said exhaust gas passageway for conducting exhaust gases from said gas burner system to a point below said fireplace.

2. A low profile fireplace as set forth in claim 1 wherein said induced draft fan is mounted on an outside wall.

3. A low profile fireplace as set forth in claim 1 wherein said fresh air venting means comprises a coaxial pipe mounted around said exhaust stack connected to a plenum in said bottom wall.

4. A low profile fireplace as set forth in claim 3 wherein said fresh air venting means further includes a transverse plenum in said bottom wall, and a longitudinal plenum in said bottom wall connected to said transverse plenum.

5. A low profile fireplace as set forth in claim 1 wherein said gas burner system comprises a plurality of gas logs and said exhaust passageway extends into said gas log system.

6. A low profile fireplace as set forth in claim 1 wherein said fresh air venting means further includes hollow corner posts connected to a plenum in said bottom wall and said top wall for conducting said combustion air into the combustion chamber of said fireplace.

7. A low profile fireplace as set forth in claim 1 wherein said fresh air venting means comprises slots in the upper panel of said bottom wall for conducting room air into the combustion chamber of said fireplace.

8. A low profile fireplace of the type for mounting under a table top in a room area, comprising:

a box shaped fireplace structure comprising a bottom wall and a top wall, vertical support posts connected to said bottom wall for supporting said top wall spaced apart from said bottom wall, said top wall further comprising an insulating means, said bottom wall comprising a plurality of panels including an upper panel, a gas burner system mounted on said bottom wall, an exhaust gas passageway extending through and above said upper panel for conveying exhaust gases downward through and below said upper panel of said bottom wall, combustion air openings between said vertical support posts for admitting combustion air into said burner system, and an induced draft fan system comprising an exhaust stack located below said upper panel of said bottom wall and connected to said exhaust gas passageway for conducting exhaust gases outside of said room area.

9. A low profile fireplace as set forth in claim 8 which further includes at least two glass panels mounted on said vertical support posts and forming transparent glass side wall panels.

10. A low profile fireplace as set forth in claim 9 which further includes room combustion air inlet slots the edges of said glass panels.

11. A low profile fireplace as set forth in claim 9 wherein said glass panels are spaced from said vertical support posts by resilient spacing means leaving air inlet slots at the top and/or bottom walls along said glass panels.

12. A low profile fireplace as set forth in claim 8 wherein said insulating means in said top wall comprises at least one horizontal air space.

13. A low profile fireplace as set forth in claim 12 wherein said horizontal air space is located between a top panel in said top wall and insulation below said table top.

14. A low profile fireplace as set forth in claim 12 wherein said insulation means comprises a plurality of vertical air spaces located between said table top and said top wall.

15. A low profile fireplace as set forth in claim 8 wherein vertical support posts are hollow and connected to a fresh air plenum in said bottom wall and said top wall.

16. A method of making a low profile gas burner fireplace of the type employed for supporting a table top, comprising the steps of:

providing a box shaped fireplace structure comprising a bottom wall and an insulated top wall, Separating said bottom wall from said top wall with connected vertical support posts, placing a gas log burner system at said bottom wall, placing glass panels on said corner support posts, placing a table top over said insulated top wall, extending and exhaust passageway through said upper panel of said bottom wall and substantially through said gas log burner system, providing fresh air combustion at the side edges of said fireplace, connecting an exhaust stack to said exhaust passageway, providing a partial pressure in said exhaust stack which is lower than the pressure surrounding the gas logs of said burner system, and providing excess fresh combustion air to form a cooling shroud around said gas logs while supplying combustion air to said burner system.

17. A method as set forth in claim 11 which further includes forming a sealed combustion chamber around said gas log burner system by the steps of:

sealing said glass panels between said top and bottom walls and said vertical corner posts, and supplying said fresh combustion air at said side edges through a plenum in said bottom wall.

* * * * *